US006975279B2

(12) United States Patent
Delgado et al.

(10) Patent No.: US 6,975,279 B2
(45) Date of Patent: Dec. 13, 2005

(54) EFFICIENT RADOME STRUCTURES OF VARIABLE GEOMETRY

(75) Inventors: Heriberto Jose Delgado, Melbourne, FL (US); William D. Killen, Melbourne, FL (US)

(73) Assignee: Harris Foundation, Melbourne, FL (US)

( * ) Notice: Subject to any disclaimer, the term of this patent is extended or adjusted under 35 U.S.C. 154(b) by 66 days.

(21) Appl. No.: 10/448,973

(22) Filed: May 30, 2003

(65) Prior Publication Data

US 2004/0239577 A1 Dec. 2, 2004

(51) Int. Cl.[7] ..... H01Q 1/42
(52) U.S. Cl. ..... 343/872; 343/787
(58) Field of Search ..... 343/872, 787

(56) References Cited

U.S. PATENT DOCUMENTS

| | | | | |
|---|---|---|---|---|
| 3,427,626 A | * | 2/1969 | Losee | 343/872 |
| 3,581,243 A | | 5/1971 | Alford | |
| 3,681,716 A | | 8/1972 | Chiron et al. | |
| 3,780,374 A | * | 12/1973 | Shibano et al. | 343/872 |
| 4,173,187 A | * | 11/1979 | Steverding | 250/515.1 |
| 4,467,330 A | * | 8/1984 | Vidal et al. | 343/872 |
| 4,638,271 A | | 1/1987 | Jecko et al. | |
| 4,896,164 A | * | 1/1990 | Burke et al. | 343/872 |
| 4,967,171 A | | 10/1990 | Ban et al. | |
| 4,999,639 A | * | 3/1991 | Frazita et al. | 343/704 |

(Continued)

FOREIGN PATENT DOCUMENTS

| | | |
|---|---|---|
| EP | 0 754 660 A1 | 1/1997 |
| EP | 1 089 374 A2 | 4/2001 |
| EP | 1 108 533 | 6/2001 |
| JP | 56-123102 | 9/1981 |
| JP | 05-211402 | 8/1983 |
| JP | 07-015218 | 1/1995 |
| JP | 08-154006 | 6/1996 |
| JP | 10/190321 | 7/1998 |
| JP | 2000307362 | 11/2000 |
| WO | WO 01-01453 A2 | 1/2001 |

OTHER PUBLICATIONS

U.S. Appl. No. 10/184,277, filed Jun. 27, 2002, Killen et al.
U.S. Appl. No. 10/185,443, filed Jun. 27, 2002, Killen et al.
U.S. Appl. No. 10/184,332, filed Jun. 27, 2002, Killen et al.
U.S. Appl. No. 10/185,251, filed Jun. 27, 2002, Parsche et al.
U.S. Appl. No. 10/185,847, filed Jun. 27, 2002, Killen et al.
U.S. Appl. No. 10/185,275, filed Jun. 27, 2002, Killen et al.
U.S. Appl. No. 10/185,273, filed Jun. 27, 2002, Killen et al.
U.S. Appl. No. 10/308,500, filed Dec. 3, 2002, Killen et al.
U.S. Appl. No. 10/373,935, filed Feb. 25, 2003, Killen et al.
U.S. Appl. No. 10/404,285, filed Mar. 31, 2003, Killen et al.
U.S. Appl. No. 10/404,981, filed Mar. 31, 2003, Killen et al.
U.S. Appl. No. 10/404,960, filed Mar. 31, 2003, Killen et al.
U.S. Appl. No. 10/185,144, filed Jun. 27, 2002, Killen et al.
U.S. Appl. No. 10/185,266, filed Jun. 27, 2002, Killen et al.
U.S. Appl. No. 10/185,162, filed Jun. 27, 2002, Rumpf, Jr. et al.
U.S. Appl. No. 10/185,824, filed Jun. 27, 2002, Killen et al.
U.S. Appl. No. 10/185,187, filed Jun. 27, 2002, Killen et al.
U.S. Appl. No. 10/185,855, filed Jun. 27, 2002, Killen et al.
U.S. Appl. No. 10/185,459, filed Jun. 27, 2002, Killen et al.
U.S. Appl. No. 10/185,480, filed Jun. 27, 2002, Killen et al.
U.S. Appl. No. 10/439,094, filed May 15, 2003, Delgado et al.

(Continued)

*Primary Examiner*—Tan Ho
(74) *Attorney, Agent, or Firm*—Sacco & Associates, PA

(57) ABSTRACT

Method for constructing a radome (110). The method can include the steps of providing a radome structure, wherein the radome structure can include at least one of a radome wall (115) and a radome frame (120). The radome structure can be impedance matched to an operational environment. The impedance match can be independent of the thickness and geometry of the radome structure.

19 Claims, 3 Drawing Sheets

U.S. PATENT DOCUMENTS

| | | | | | |
|---|---|---|---|---|---|
| 5,017,939 | A | * | 5/1991 | Wu | 343/911 R |
| 5,408,244 | A | * | 4/1995 | Mackenzie | 343/872 |
| 5,600,325 | A | | 2/1997 | Whelan et al. | 342/13 |
| 5,631,663 | A | * | 5/1997 | David et al. | 343/872 |
| 5,714,112 | A | | 2/1998 | Hazeyama et al. | |
| 5,724,052 | A | | 3/1998 | Boulingre et al. | 343/872 |
| 6,028,565 | A | * | 2/2000 | Mackenzie et al. | 343/872 |
| 6,107,976 | A | * | 8/2000 | Purinton | 343/872 |
| 6,323,825 | B1 | * | 11/2001 | Zidek et al. | 343/872 |
| 6,424,308 | B1 | | 7/2002 | Wu et al. | 343/753 |
| 6,788,273 | B1 | * | 9/2004 | Schultz et al. | 343/909 |

OTHER PUBLICATIONS

Marques, Ricardo; Medina, Francisco; and Rafii–El–Idrissi, Rachid; "*Role of bianisotropy in negative permeability and left handed metamaterials" The American Physical Society*, p. 65. <<http://physics.ucsd.edu/~drs/publications/marques_prb_2002.pdf>>.

Johnson, R. Colin, "*Metamaterial holds promise for antennas, optics*" <<http://www.edtn.com/story/0EG20010430S0110>>.

Antennas for Communications. Radome Network <<http://www.radome.net/>>.

Itoh, T.; et al: "Metamaterials Structures, Phenomena and Applications" IEEE Transactions on Microwave Theory and Techniques; Apr., 2005; [Online} Retrieved from the Internet: URL:www.mtt.org/publications/Transactions/CFP_Metamaterials.pdf>.

Kiziltas, G.; et al: "Metamaterial design via the density method" IEEE Antennas and Propagation Society Int'l Symposium 2002, vol. 1, Jun. 16, 2002 pp 748–751, Piscataway.

Salahun, E.; et al: "Ferromagnetic composite–based and magnetically–tunable microwave devices" IEEE MTT–S Microwave Symposium Digest, vol. 2, Jun. 2, 2002 pp1185–1188.

* cited by examiner

EFFICIENT RADOME STRUCTURES OF VARIABLE GEOMETRY

BACKGROUND OF THE INVENTION

1. Technical Field

The present invention relates to the field of radomes, and more particularly to efficient radomes of variable geometry.

2. Description of the Related Art

Conventional radomes are typically dome-like shells that can be used to protect enclosed electromagnetic devices, such as antennas, from environmental conditions, such as wind, solar loading, ice, and snow. Radomes, such as a solid laminate and sandwich radomes, can be rigid self-supporting structures. Mismatches between the impedance of free space and the radome can result in energy dissipation at the point of incidence. The energy dissipation can be the result of a reflective wave being generated at a medium boundary, such as the radome/free-space boundary.

If an electromagnetic wave strikes a medium boundary at a point which is multiple of a half wavelength, energy dissipation at the boundary can be minimized. A material which minimizes reflections across medium boundaries by ensuring electromagnetic incidence occurs at half-wavelength multiples for a selected frequency utilizes an impedance transform. Advantageous transfer characteristics for conventional radomes are generally achieved through such a wavelength dependant impedance transform. More particularly, half-wavelength transforms can be advantageously used to achieve beneficial transfer characteristics.

Relying upon such an impedance transform, however, results in radomes optimized for specific frequencies and places a limitation upon radome thickness. The further the deviation from the optimized frequency, the greater the perturbations caused by the exemplary conventional radome; since the half-wavelength transform cannot properly function for differing wavelengths. Consequently, conventional radomes are frequency dependant.

Differing angles of incidence also substantially affect the transfer characteristics of conventional radomes. Different angles of incidence cause waves to travel different distances through a uniformly thick medium. For example, a wave at normal incidence passing through a 1.5 cm thick medium travels 1.5 cm.

distance=thickness/sin(incident angle), so that distance=1.5 cm/sin 90=1.5 cm/1=1.5 cm Alternately, a wave at a 30 degree incident angle passing through the same medium (ignoring refraction) travels a distance of 3.0 cm.

distance=thickness/sin(incident angle), so that distance=1.5 cm/sin 30=1.5 cm/0.5=3.0 cm Consequently, performance of conventional radomes is significantly affected by various incident angles.

To minimize differences in incident angles, conventional radomes are often hemispherically shaped. Accordingly, if a radio frequency source is centrally placed within a hemispherical radome, waves generated by the source will strike the radome boundary at a substantially normal angle of incidence. Other shapes would result in differing angles of incidence, thereby degrading radome performance characteristics.

A number of difficulties result from the necessity that conventional radomes be hemispherically shaped. For example, manufacturing and transportation considerations cause most large conventional radomes to be formed from multiple-curved panels that can be joined on-site to form the radome structure. The coupling planes at which adjacent panels are joined, however, can cause thickness variations. The thickness variations can result in decreased radome performance at the coupling planes—the coupling planes being the seams in a radome wall existing between joined radome panels. To minimize loss at panel boundaries, panels are made as large as practicable for a given situation. It can be very difficult to transport, install, and manufacture the large, rigid, and curved radome panels.

Another negative aspect of conventional radomes relates to radome frames. A radome frame is a supporting framework that provides mechanical support to a radome. Such additional support can be necessary since radome walls, which utilize wavelength dependant impedance transforms, are thickness restricted, generally to multiples of half a wavelength of an optimized frequency. Conventional radomes can require support greater than that provided by material which is half a wavelength thick.

For example, a large radome, such as the 140-foot diameter radome at Mt. Hebo, may need to be constructed of a dielectric material thicker than the lowest half wavelength, which would be 1.5 cm for a 10 GHz frequency. Increasing thickness of a radome wall to the next higher half wavelength multiple can significantly increase the cost to manufacture the radome wall. Additionally, increased losses due to the magnetic and electric loss tangents occur as the thickness of a radome increases. Accordingly, load bearing radome frames are often used in conjunction with radome walls.

Losses attributable to radio frequency waves striking radome frames can be called scatter loss. Scatter loss of conventional radomes with radome frames can be as great as 10 times the wall pass loss. While many different approaches have been taken to minimize scatter loss, scatter loss remains a significant problem for conventional radomes with radome frames.

SUMMARY OF THE INVENTION

The invention concerns a method for constructing a radome. The method can include the steps of providing a radome structure and impedance matching the radome structure to an operational environment, wherein the impedance match is independent of the thickness and geometry of the radome structure. The impedance match can be achieved independent of a frequency and an angle of incidence of radio frequency signals that pass through the radome structure. Additionally, a plurality of panels can be joined to form the radome structure. The coupling plain between adjacent ones of the plurality of panels can be impedance matched to the operational environment. The radome structure can be subdivided into a plurality of segments for shipping. The thickness of at least a portion of the radome structure can vary across the surface of that portion.

According to one aspect of the invention, the radome structure can include at least one of a radome wall and a radome frame. An electrical characteristic can be selected for the radome structure from a permittivity, a permeability, a loss tangent, and/or a reflectivity. The selected electrical characteristic can be adjusted to achieve the impedance matching for the radome structure. For example, a relative magnetic permeability of the radome structure to can be adjusted to approximately equal a relative electrical permittivity of the radome structure. The radome structure can also be formed from a dielectric material within which a plurality of voids can be created. Further, a plurality of magnetic particles can be inserted into selective ones of the voids.

The invention also concerns a radome. The radome includes a radome structure, wherein electrical characteristics of the radome structure result in an impedance match with an operational environment, where the impedance match is independent of the thickness and geometry of the radome structure. The radome structure can include a radome wall and a radome frame. The impedance match can be independent of the frequency and the angles of incidence of radio frequency waves which pass through the radome structure. A relative magnetic permeability of the radome structure can approximately equal a relative electrical permittivity of the radome structure.

At least a portion of the radome structure can be formed from a dielectric material that includes magnetic particles. The magnetic particles can include a ferroelectric material, a ferromagnetic material, and/or a ferrite. At least a portion of the dielectric material can also include a plurality of voids. The radome structure can further include a plurality of panels, wherein a coupling plane joining adjacent ones of the plurality of panels is impedance matched to the operational environment. The radome structure can be of variable thickness. The radome can be subdivided into a plurality of segments for shipping.

The invention also concerns a method for minimizing reflection of a radio frequency signal as it traverses a radome boundary. The method includes the steps of interposing at least one radome panel in the path of a radio frequency signal and selecting a permeability and a permittivity of a material forming the radome panel. The permeability and permittivity should be selected so that a ratio of the relative permeability to the relative permittivity is substantially equal to a ratio of a relative permeability to a relative permittivity of an environment surrounding the radome panel. The relative permittivity and the relative permeability of the radome panel can be selected to be substantially equal. The radome panel can be formed from a dielectric material having a plurality of voids, each void being between about one millimeter and one nanometer in size.

BRIEF DESCRIPTION OF THE DRAWINGS

There are shown in the drawings embodiments, which are presently preferred, it being understood, however, that the invention is not limited to the precise arrangements and instrumentalities shown.

DETAILED DESCRIPTION OF THE INVENTION

Figure 1A:
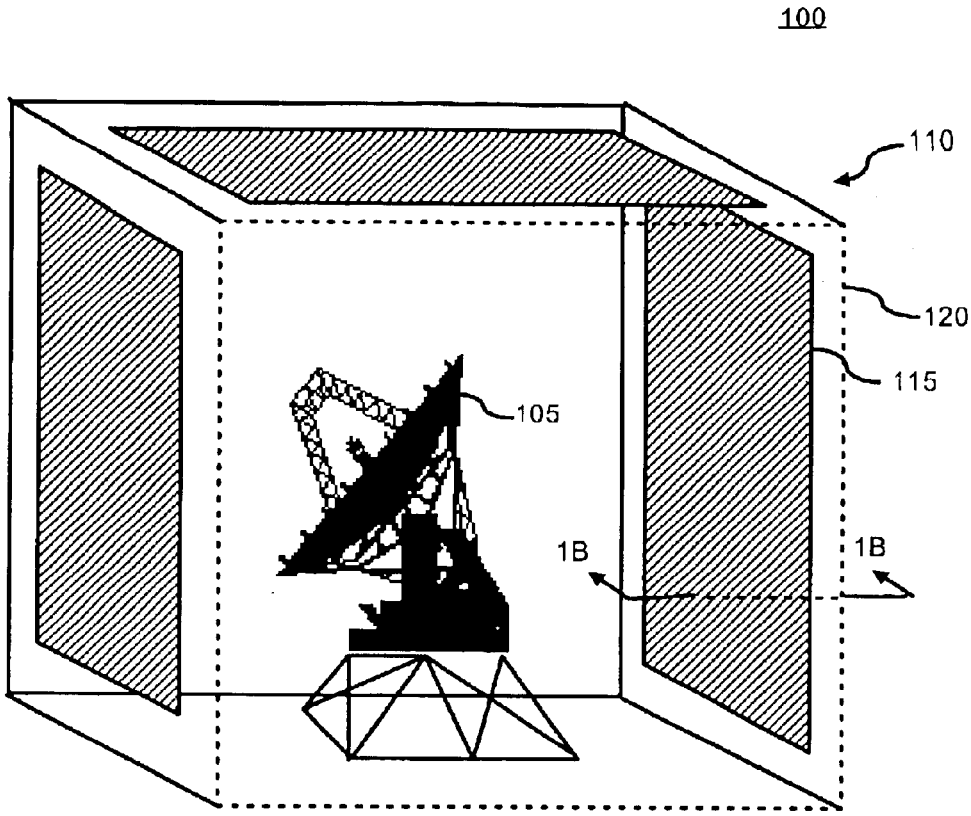
FIG. 1A is a schematic diagram illustrating an exemplary variably shaped radome in accordance with the inventive arrangements disclosed herein.

FIG. 1A is a schematic diagram illustrating an exemplary radome system 100 in accordance with the inventive arrangements disclosed herein. The system 100 can include an electromagnetic device 105 and a radome 110, which includes a radome wall 115 and a radome frame 120. The electromagnetic device 105 can be a transceiver coupled to an antenna.

The radome 110 can be an environmental shell configured to be substantially transparent to radio frequency radiation in the frequency range of interest. The radome 110 protects the enclosed electromagnetic device 105 from environmental conditions. Radome 110 can be a variety of types including, but not limited to, a space frame radome, a sandwich radome, and a solid laminate radome. The radome 110 can be designed for particular performance characteristics relating to radio frequency radiation. For example, radome 110 can be impedance matched to the surrounding environment (i.e. free space). Accordingly, radome 110 need not utilize impedance transforms that are wavelength dependent. Therefore, radome 110 can efficiently operate even when electromagnetic waves strike the radome structure at different angles of incidence. Consequently, radome 110 can be of variable thickness and shape.

The radome wall 115 can be designed for specific electrical characteristics that result in desired performance characteristics for the radome 110. For example, the radome wall 115 can have a relative electrical permittivity equal to a relative magnetic permeability resulting in an impedance match with free space. Electrical characteristics can include a permittivity, a permeability, a loss tangent, and/or a reflectivity. The radome wall 115 can comprise a single surface or multiple surface segments, each of which can be formed from the same or different materials. Various materials can be used to construct the radome wall 115. The selected material can depend upon necessary electrical characteristics required for the radome wall 115 to achieve desired performance characteristics for the radome 110.

The radome frame 120 can be a load bearing structure that provides mechanical support to the radome 110. The radome frame 120, unlike traditional radome frames, can be impedance matched to the environment in a manner similar to the radome wall 115. As used herein, the radome frame 120 can be any structure which provides greater mechanical support than the structure defined as the radome wall 115. Appreciably, since both the radome wall 115 and the radome frame 120 can have a variable thickness, traditional distinctions between the radome wall 115 and the radome frame 120 can be blurred as applied herein.

For example, in one embodiment, the radome frame 120 can be indistinguishable from the radome wall 115, except that the radome frame 120 is thicker than the radome wall 115, resulting in enhanced structural support. In another embodiment, the radome frame 120 can be an equivalent thickness to the radome wall 115, yet formed from a different material selected to provide enhanced structural support.

Figure 1B:
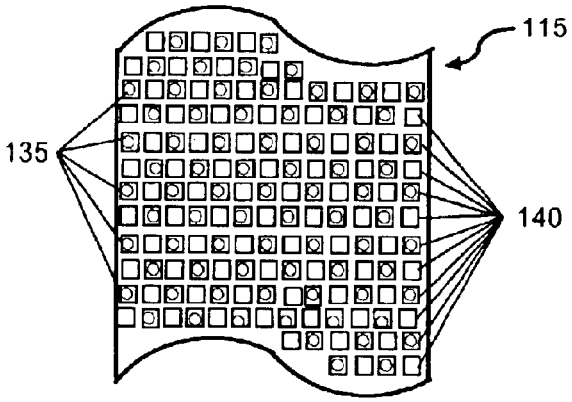
FIG. 1B is an enlarged view of a cross section view of the radome of FIG. 1A.

FIG. 1B is an enlarged view of a cross section of the radome wall 115. A dome material forming the radome wall 115 can comprise numerous voids 140 some of which are filled with magnetic particles 135. Voids 140 can provide low dielectric constant portions within the dome material since voids 140 generally fill with air, air being a very low dielectric constant material. Other voids 140 can be filled with a filling material resulting in portions of the dome material having tailored dielectric properties that differ from the bulk properties of the dome material. The fill material can include a variety of materials which can be chosen for desired physical properties, such as electrical, magnetic, or dielectric properties. Voids 140 can occupy regions as large as several millimeters in area or can occupy regions as small as a few nanometers in area.

The voids 140 can be selectively filled by the magnetic particles 135 in a variety of manners. For example, particle filling may be provided by microjet application mixing techniques known in the art, where a polymer intermixed with magnetic particles 135 is applied to voids 140. Photonic radiation can be used to remove macroscopic or microscopic regions in the dome material to create voids 140 using various mechanisms, such as polymeric end group degradation, unzipping, and/or ablation. A $CO_2$ laser is preferred when creating voids by utilizing a laser. An optional planarization step may be added if filling initially results in a substantially non-planar surface and a substantially planar surface is desired.

Magnetic particles 135 include materials that have a significant magnetic permeability, which refers to a relative magnetic permeability of at least 1.1. Magnet particles 135 can be metallic and/or ceramic particles and can have sub-micron physical dimensions. Preferably, magnetic particles 135 comprise a ferroelectric material, a ferromagnetic material, and/or a ferrite.

Ferroelectric materials, which contain microscopic electric domains or electric dipoles, can exhibit a hysteresis property so that the relationship between an applied electric field and the relative dielectric constant of the cross section 125 is non-linear. Ferroelectric compounds include, for example, potassium dihydrogen phosphate, barium titanate, ammonium salts, strontium titate, calcium titanate, sodium niobate, lithium niobate, tunsten trioxide, lead zirconate, lead hafnate, guanidine aluminium sulphate hexahydrate, and silver periodate.

Ferromagnetic materials, which contain microscopic magnetic domains or magnetic dipoles, can form a hysteresis loop when selected energetic stimuli are applied to create an applied magnetic field across the dome material. The hysteresis loop being a well-known effect of variation of an applied magnetic field. The hysteresis loop results from a retardation effect based upon a change in the magnetism of the dome material lagging behind changes in an applied magnetic field. Ferromagnetic materials include, but are not limited to, cobalt, iron, nickel, and mumetal.

Ferrites are a class of solid ceramic materials with crystal structures formed by sintering at high temperatures stoichiometric mixtures of selected oxides, such as oxygen and iron, cadmium, lithium, magnesium, nickel, zinc, and/or with other materials singularly or in combination with one another. Ferrites typically exhibit low conductivities and can possess a magnetic flux density from 0 to 1.4 tesla when subjected to a magnetic field intensity from negative 100 A/m to positive 100 A/m.

The selection and placement with which the magnetic particles 135 are incorporated into the dome material can determine the electrical characteristics of the dome material, thereby determining the performance characteristics of the radome 110. The magnet particles 135 can be uniformly distributed or can be otherwise dispersed (e.g. randomly distributed) within the dome material.

In one embodiment, the dome material can be a metamaterial. A metamaterial refers to composite materials formed from the mixing or arrangement of two or more different materials at a very fine level, such as the angstrom or nanometer level. Metamaterials allow tailoring of electrical characteristics of the dome material, which can be defined by effective electromagnetic parameters comprising effective electrical permittivity $\epsilon_{eff}$ (or dielectric constant) and the effective magnetic permeability $\mu_{eff}$.

Figure 2:
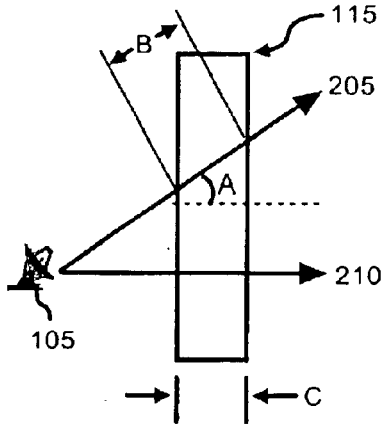
FIG. 2 is a schematic diagram illustrating waves passing through the radome of FIG. 1A.

FIG. 2 is a schematic diagram illustrating waves 205 and 210 passing through wall 115 to demonstrate that radome 110 efficiently operates at any angle of incidence. FIG. 2 includes wave 205 with an incident angle A with respect to the wall 115 and wave 210 with a normal angle of incidence.

As previously noted, conventional radomes use an impedance transform based upon a multiple of a determined wavelength. Such an impedance transform requires that the conventional radome be of a predetermined thickness, such as a half multiple of a wavelength for a selected frequency. Notably, the distance a wave travels through the radome can vary according to the angle at which the wave strikes the conventional radome, i.e. distance=thickness/sin(incident angle). Therefore, a conventional radome, which must be of a particular thickness, can efficiently operate only for a predefined frequency and a specified angle of incidence, such as a normal angle.

In contrast, the radome wall 115 can be impedance matched to the surrounding environment (i.e. free space) and can be of variable thickness. Moreover, the distances B and C that waves 205 and 210 travel through the radome wall 115 is not significant to the efficient operation of radome 110. Accordingly, the radome wall 115 can efficiently operate for any angle of incidence, such as angle A, thereby allowing for variably shaped radomes.

It should be noted as an aside, that the magnetic and electrical loss tangents for the radome 110 can be affected by the angle A and the thickness of radome wall 115. Hence, performance characteristics for radome 110 are not entirely independent of the thickness of the radome wall 115 and/or the angle of incidence. When the radome 110 is sufficiently thin, however, the magnetic and electrical loss tangents can result in minimal losses.

Figure 3A:
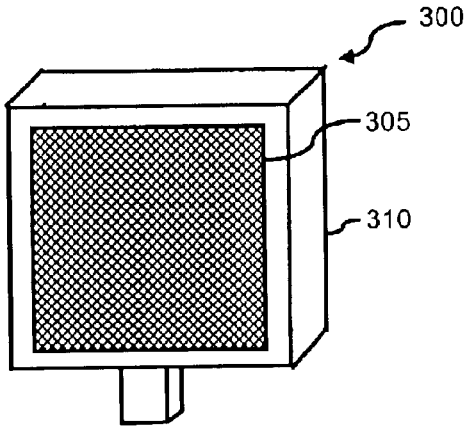
FIG. 3A is a schematic diagram illustrating one shape for the radome of FIG. 1A.

FIG. 3A is a schematic diagram illustrating radome 300 depicting one of the possible shapes of the radome of FIG. 1A. Radome 300 can include a radome wall 305 and a radome frame 310. Radome 300 illustrates that each side of a magnetic radome need not be of uniform thickness. For example, one side of radome 300 contains radome wall 305, which is thinner than the surrounding radome frame 310. Other sides of radome 300 can lack a radome wall and can be of the same thickness and composition as the radome frame 310. The radome wall 305 can be formed from the same material as the radome frame 310 or can be formed from a different material.

Figure 3B:
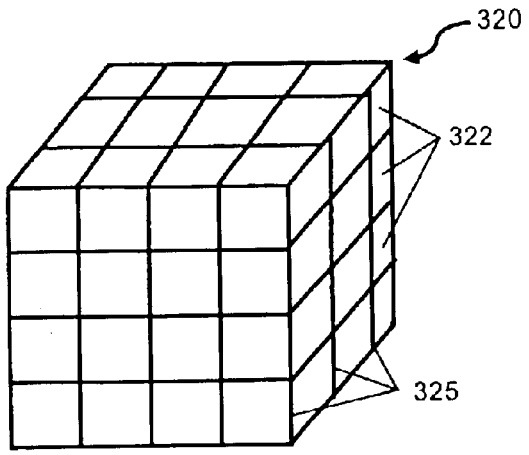
FIG. 3B is a schematic diagram illustrating another shape for the radome of FIG. 1A.

FIG. 3B is a schematic diagram illustrating radome 320 depicting another of the possible shapes of the radome of FIG. 1A. As shown, the radome 320 can include a radome wall formed of many panels 322, each panel 322 supported by a radome frame 325. Radome 320 illustrates that each side of an impedance matched radome can comprise multiple panels 322 interspersed with radome frame 325 elements. Different ones of the panels 322 can be constructed with different electrical characteristics. Likewise, the frame 325 of the radome 320 can comprise different sections differentially constructed. Of course, radome 320 can be of any shape and is not restricted to the square shape indicated and panels 322 can be curved and/or flat.

Constructing radome 320 as a series of panels 322 can allow the size of the radome 320 to be adjusted by adding or subtracting panels 322 to various sides of the radome 320. Since the radome 320 is frequency independent, operational radomes of any size and frequency range can be constructed from a plurality of standardized panels 322. The ability to standardize panels 322 of the radome 320 can promote manufacturing efficiencies, resulting in less costly radomes that nevertheless possess desired performance characteristics.

Figure 3C:
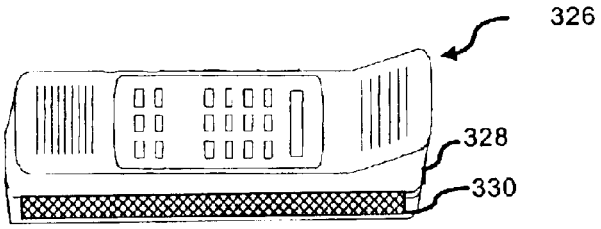
FIG. 3C is a schematic diagram illustrating yet another shape for the radome of FIG. 1A.

FIG. 3C is a schematic diagram illustrating radome 326 depicting another of the possible shapes of the radome of FIG. 1A. Radome 326 demonstrates that variably shaped radomes can be molded and/or constructed to conform to any shape and/or housing. Such a housing can be integrated into a protected device or structure. For example, the radome 326 can protect a microstrip antenna contained within a cellular telephone. The radome 326 can include a radome frame 328 and a radome wall 330.

In particular embodiments, the radome 326, need not be a separate enclosure for the electromagnetic device, but can instead be integrated with the protected electromagnetic device. For example, the radome 326 can be integrated with a cellular telephone so that various electronic components necessary for operating the cellular telephone can be embedded within the surface material of the radome 326.

Figure 3D:
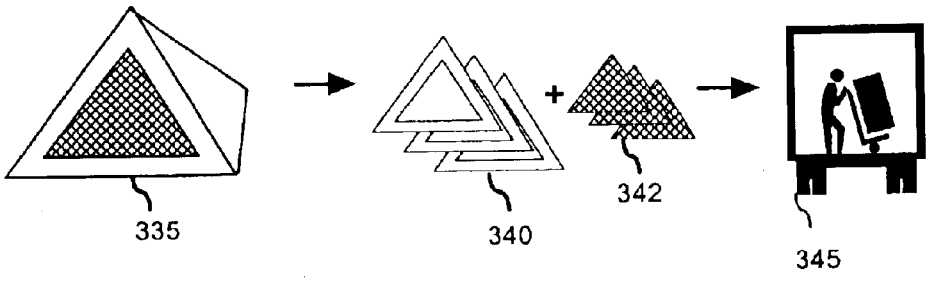
FIG. 3D is a schematic diagram illustrating transport characteristics for the radome of FIG. 1A.

FIG. 3D is a schematic diagram illustrating transport characteristics for the radome of FIG. 1A. More particularly, FIG. 3D shows a radome 335, frame elements 340, panel sections 342, and a transport symbol 345. The radome 335 can be easily segmented to facilitate transportation. Radome 335 is depicted as a pyramidal radome with three sides, each of which can be segmented into sections comprising frame elements 340 and panel sections 342. Each of the shown sections 340 and 342 can additionally be decomposed into smaller sections (not shown). Although shown as a pyramid shape, the radome 335 can be any shape and/or size. Once decomposed, the radome 335 can be easily transported 345 since any segmentation size is possible.

In contrast, conventional radome panels can be very large in order to minimize the number of seams created. Sometimes individual radome panels are so large as to not be transportable via standard transport channels. Even when standard transport channels can be used, because each panel is curved, bulky, and thin, special shipping packaging is often required to safely ship a conventional radome. Custom packaging is not required for radome 335.

Further, the assembly of conventional radomes is problematic with large fragile panels needing to be positioned in precise orientations using minimal inter-panel couplings. Radome 335, however, can be designed to include hinges, interlocking edges, and other coupling mechanisms that facilitate assembly. For example, the radome 335 can be hinged to 'collapse' into a flat structure to be later re-assembled. The radome 335 is not limited to any particular manner of decomposition or segmentation shape, size, or intersegment coupling mechanism resulting in enhanced flexibility in design, manufacture, transport, and installation.

Figure 4:
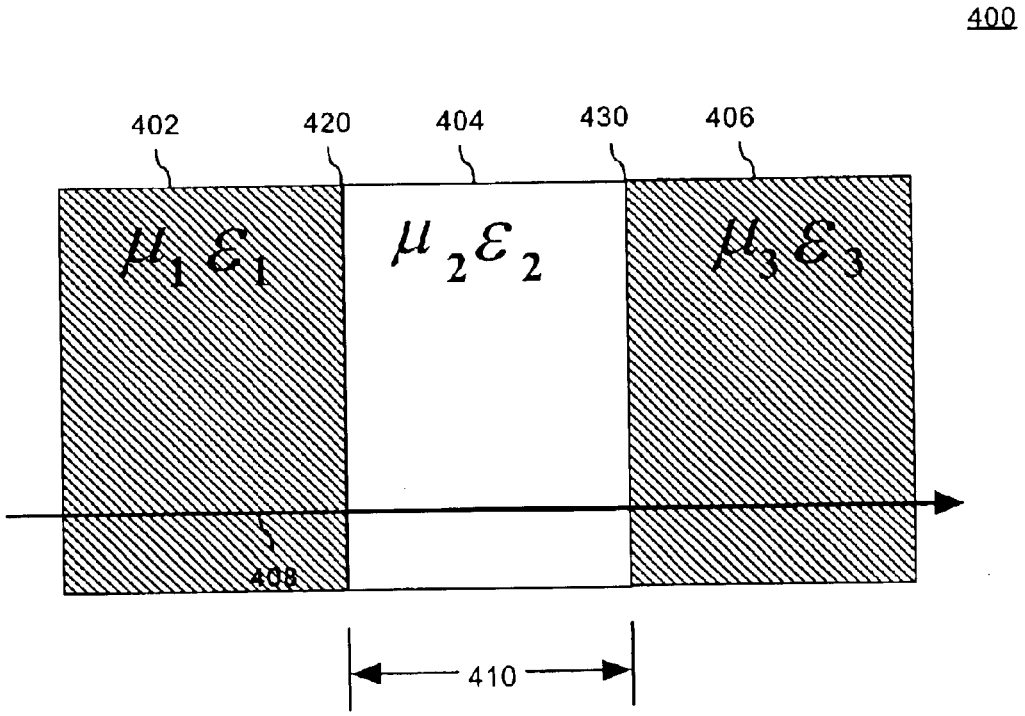
FIG. 4 is a schematic diagram illustrating a system including a wave at normal incidence passing across two boundaries separating three mediums.

FIG. 4 is a schematic diagram illustrating a system 400 including a wave 408 at normal incidence passing across two boundaries separating three mediums. FIG. 4 details how a radome (depicted as medium 404) can be impedance matched to free space (mediums 402 and 406). The system 400 can include boundary 420 separating medium 402 and medium 404 and boundary 430 separating medium 404 and medium 406. Mediums 402, 404, and 406 have relative permittivity values of $\epsilon_1$, $\epsilon_2$, and $\epsilon_3$ and relative permeability values of $\mu_1$, $\mu_2$, and $\mu_3$, respectively.

Whenever the equation $\mu_2\epsilon_1=\mu_1\epsilon_2$ is satisfied, transmission of radio frequency waves at normal incidence can occur across boundary 420 without significant reflection. Similarly, when $\mu_2\epsilon_3=\mu_3\epsilon_2$ is satisfied, transmission of radio frequency waves at normal incidence can occur across boundary 430 without significant reflection. While, the above equations may not be dependant on length 410, observable loss will occur as a function of length 410 resulting from non-zero electric and magnetic loss tangents. Accordingly, length 410 should generally be kept as short as possible.

For example, assume medium 402 and 406 are both air and that medium 404 is a radome wall. The relative permeability and permittivity of air is approximately one (1). Accordingly, $\mu_1$ and $\mu_3$ are approximately equal one (1) and $\epsilon_1$ and $\epsilon_3$ are approximately equal one (1). Assume that the exemplary radome wall, which is represented by medium 404, has an electrical permittivity of two (2). Thus, when the radome wall has a magnetic permeability of two (2), a wave 408 with a normal angle of incidence can be transmitted across boundary 420 without significant reflection. Furthermore in this example, because medium 402 and medium 406 are equivalent dielectric mediums (both air), boundary 430 will also be impedance matched, since the intrinsic impedance is identical in mediums 404 and 406.

The relationship for complete transmission across an ideal boundary 420 for an ideal wave 408 at normal incidence can be determined as follows. The intrinsic impedance ($\eta$) for a given medium can be defined as $\eta=(\mu/\epsilon)^{1/2}$ so that the intrinsic impedance for medium 402 is $\eta_1=(\mu_1/\epsilon_1)^{1/2}$ and intrinsic impedance for medium 404 is $\eta_2=(\mu_2/\epsilon_2)^{1/2}$. Next, the reflection coefficient ($\Gamma$) for a plane wave 408 normal to boundary 420 can be defined as $\Gamma=(\eta_2-\eta_1)/(\eta_2+\eta_1)$. All energy can be transmitted at across boundary 420 if the reflection coefficient is zero; that is $\Gamma=(\eta_2-\eta_1)/(\eta_2+\eta_1)=0$.

Using the above formulas, the following calculations can be made:

$$(\eta_2-\eta_1)/(\eta_2+\eta_1)=0 \quad (1)$$

$$(\eta_2-\eta_1)=0 \quad (2)$$

$$\eta_2=\eta_1 \quad (3)$$

$$(\mu_2/\epsilon_2)^{1/2}=(\mu_1/\epsilon_1)^{1/2} \quad (4)$$

$$(\mu_2/\epsilon_2)=(\mu_1/\epsilon_1) \quad (5)$$

$$\mu_2\epsilon_1=\mu_1\epsilon_2 \quad (6)$$

Equation (1) sets the reflection coefficient equation to zero. Equation (2) results from multiplying both sides of equation (1) by $(\eta_2+\eta_1)$. Equation (3) results from adding $\eta_1$ to both sides of equation (2). Equation (4) results from substituting in the defined values for $\eta_2$ and $\eta_1$ into equation (3). Squaring both sides of equation (4) results in equation (5). Equation (6) results from multiplying both sides of equation (5) by $(\epsilon_1)(\epsilon_2)$. Accordingly, when equation (6) is satisfied, an intrinsic impedance match between medium 402 and medium 404 will result. Accordingly, normally incident wave 408 is fully transmitted as no reflection loss results for normally incident wave 408 at the ideal boundary 420 when equation (6) is satisfied.

As seen in the above example, when $\mu_3\epsilon_1=\mu_1\epsilon_3$, matching the impedance of medium 404 to medium 402 at boundary 420 can result in an impedance match of medium 404 to medium 406 at boundary 430. However, when mediums 402 and 406 have dissimilar electrical permittivity and magnetic permeability values, it is not generally possible to perform an impedance match at boundaries 420 and 430 using the above formulas alone. In such a situation, an impedance transform can be utilized.

The present invention can be embodied in other forms without departing from the spirit or essential attributes thereof. Accordingly, reference should be made to the following claims, rather than to the foregoing specification, as indicating the scope of the invention.

What is claimed is:

1. A method for constructing a radome, comprising the steps of:

providing a radome structure, wherein said radome structure comprises at least one of a radome wall and a radome frame; and, matching a characteristic impedance of a material forming said radome structure to a characteristic impedance of free space independent of the thickness and geometry of said radome structure.

2. A method according to claim 1, further comprising the steps of:

matching said characteristic impedance of said material to a characteristic impedance of free space independent of a frequency and an angle of incidence of radio frequency signals that pass through said radome structure.

3. A method for constructing a radome, comprising the steps of:

providing a radome structure, wherein said radome structure comprises at least one of a radome wall and a radome frame;

impedance matching said radome structure to an operational environment independent of the thickness and geometry of said radome structure;

selecting an electrical characteristic for said radome structure from the group consisting of a permittivity, a permeability, a loss tangent, and a reflectivity; and, adjusting said selected electrical characteristic to achieve said impedance matching for said radome structure.

4. The method according to claim 3, said adjusting step further comprising the step of:

adjusting a relative magnetic permeability of said radome structure to approximately equal a relative electrical permittivity of said radome structure.

5. The method of claim 4, said adjusting step further comprising the steps of:

forming said radome structure using a dielectric material;

creating a plurality of voids within said dielectric material; and, inserting a plurality of magnetic particles into selective ones of said voids.

6. A method for constructing a radome, comprising the steps of:

providing radome structure, wherein said radome structure comprises at least one of a radome wall and a radome frame;

impedance matching said radome structure to an operational environment independent of the thickness and geometry of said radome structure;

varying a thickness of at least a portion of said radome structure.

7. A method for constructing a radome, comprising the steps of:

providing a radome structure, wherein said radome structure comprises at least one of a radome wall and a radome frame;

impedance matching said radome structure to an operational environment operational environment independent of the thickness and geometry of said radome structure;

joining a plurality of panels to form said radome structure; and, impedance matching a coupling plane between adjacent ones of said panels to said operational environment.

8. The method according to claim 7, further comprising the steps of:

joining said radome wall to said radome frame; and, impedance matching a coupling plane between said radome wall and said radome frame to said operational environment.

9. A radome structure comprising at least one of a radome wall and a radome frame, wherein a plurality of electrical characteristics of a material forming said radome structure define a characteristic impedance of said radome structure that is matched with a characteristic impedance of free space independent of the thickness and geometry of said radome structure.

10. The radome structure according to claim 9, wherein said impedance match between said characteristic impedance of said radome structure and said characteristic impedance of free space is independent of frequency and angle of incidence of radio frequency waves which pass through said radome structure.

11. A radome structure comprising at least one of a radome wall and a radome frame:

a plurality of electrical characteristics of said radome structure defining a characteristic impedance of said radome structure that is matched with an operational environment independent of the thickness and geometry of said radome structure;

wherein at least of a portion of said radome structure is formed from a dielectric material, and said dielectric material comprises magnetic particles.

12. The radome structure according to claim 11, wherein said magnetic particles comprise material selected from the group consisting of a ferroelectric material, a ferromagnetic material, and a ferrite.

13. The radome structure according to claim 12, wherein a relative magnetic permeability of said radome structure approximately equals a relative electrical permittivity of said radome structure.

14. A radome structure comprising at least one of a radome wall and a radome frame:

a plurality of electrical characteristics of said radome structure defining a characteristic impedance of said radome structure that is matched with an operational environment independent of the thickness and geometry of said radome structure;

wherein said radome structure comprises a plurality of panels, and a coupling plane joining adjacent ones of said plurality of panels is impedance matched to said operational environment.

15. A radome structure comprising at least one of a radome wall and a radome frame:

a plurality of electrical characteristics of said radome structure defining a characteristic impedance of said radome structure that is matched with an operational environment independent of the thickness and geometry of said radome structure;

wherein a coupling plane joining said radome wall and said radome frame is impedance matched to said operational environment.

16. A radome structure comprising at least one of a radome wall and a radome frame:

plurality of electrical characteristics of said radome structure defining a characteristic impedance of said radome structure that is matched with an operational environment independent of the thickness and geometry of said radome structure;

wherein said radome structure is of variable thickness.

17. A method for minimizing reflection of a radio frequency signal (RF) as the radio frequency signal traverses a radome boundary, comprising the steps of:

interposing at least one radome panel in the path of the RF signal; and, selecting a permeability and a permittivity of a material forming said radome panel so that a ratio of said relative permeability to said relative permittivity is substantially equal to a ratio of a relative permeability to a relative permittivity of an environment surrounding said radome panel.

18. The method of claim 17, further comprising the step of:

selecting said relative permittivity and said relative permeability of said radome panel to be substantially equal.

19. The method of claim 17, further comprising the step of:

forming said radome panel from a dielectric material having a plurality of voids; and, selecting a size of said voids between about one millimeter and one nanometer.

* * * * *